United States Patent [19]

Inano et al.

[11] Patent Number: 4,752,762

[45] Date of Patent: Jun. 21, 1988

[54] ORGANIC POSITIVE TEMPERATURE COEFFICIENT THERMISTOR

[75] Inventors: Mitsumasa Inano; Toshiya Ohshima, both of Nagaokakyo, Japan

[73] Assignee: Murata Manufacturing Co., Ltd., Japan

[21] Appl. No.: 813,706

[22] Filed: Dec. 27, 1985

[30] Foreign Application Priority Data

Dec. 29, 1984 [JP] Japan ..... 59-280365

[51] Int. Cl.[4] ..... H01C 7/10

[52] U.S. Cl. ..... 338/22 R; 338/22 SD

[58] Field of Search ..... 338/22 R, 22 SD, 23, 338/224, 225, 375; 219/505; 29/612

[56] References Cited

U.S. PATENT DOCUMENTS

| | | | |
|---|---|---|---|
| 3,728,660 | 4/1973 | Finney | 338/23 X |
| 4,315,237 | 2/1982 | Middleman et al. | 338/22 R |
| 4,447,799 | 5/1984 | Carlson | 338/22 R |
| 4,544,828 | 10/1985 | Shinenobu et al. | 338/22 SD X |

*Primary Examiner*—E. A. Goldberg
*Assistant Examiner*—Marvin M. Lateef
*Attorney, Agent, or Firm*—Ostrolenk, Faber, Gerb & Soffen

[57] ABSTRACT

A thermistor element having a positive temperature-resistance coefficient. Electrodes are connected to the positive characteristic thermistor element, around which an outer member of an armor material is formed. The armor material is composed of a synthetic resin, in which 60–80 wt. % of an insulating filler consisting of, for example, silica, alumina or the like is mixed.

4 Claims, 1 Drawing Sheet

ORGANIC POSITIVE TEMPERATURE COEFFICIENT THERMISTOR

BACKGROUND OF THE INVENTION

1. Field of the Invention

The present invention relates to an organic positive temperature coefficient thermistor. More specifically, the present invention relates to an organic positive temperature coefficient thermistor, in which an outer member is formed around a positive temperature coefficient thermistor element comprising a high-molecular material mixed with carbon black or the like.

2. Description of the Prior Art

An organic positive temperature coefficient thermistor of interest is disclosed, for example, in U.S. Pat. No. 4,315,237, issued Feb. 9, 1982.

In the organic positive temperature coefficient thermistor, the thermistor element absorbs oxygen, which causes the deterioration of electrical temperature coefficient such as an increase in the initial resistance value. A barrier or an outer member is formed, therefore, around the thermistor element to prevent the deterioration thereof. The outer member is formed of resins, for example, epoxy resin. In this case, the higher the bridging density of the resin the better for preventing the deterioration.

When the bridging density of the resin of the outer member is high, a firm tertiary structure is formed, so that in products (thermistors), a crack may occur in heat-shock testing. For example, by the heat-shock test (−50° C.–+120° C.), cracks in the outer member or damage to the thermistor element and the electrode may occur. This is substantially problematic when using the organic positive temperature coefficient thermistor, for example, as a circuit protector, because the function thereof is not completely performed.

SUMMARY OF THE INVENTION

Therefore, the a principal object of the present invention is to provide an organic positive temperature coefficient thermistor having a stable electrical temperature coefficient and a high heat-shock resistance.

The present invention relates to an organic positive temperature coefficient thermistor using resin containing 60 wt%–80 wt% of an insulating filler as an outer member.

The filler contained in the resin functions to scatter bubbles within the outer member. As the result, it serves to absorb and moderate the difference of thermal expansion coefficient with the thermistor element by the outer member. Besides, the content of filler is determined within a serviceable range as the outer member from the viewpoint of the electrical temperature coefficient of the organic positive temperature coefficient thermistor.

According to an aspect of the present invention, since the outer member in which 60–80 wt % of an insulating filler is contained absorbs and moderates the difference of thermal expansion with the thermistor element, the cracks of outer member or the damages of organic positive temperature coefficient thermistor element or electrode may be suppressed. Moreover, since the outer member shields the oxygen moderately, the deterioration of the electrical temperature coefficient due to the oxygen absorption may be avoided.

These objects and other objects, features, aspects and advantages of the present invention will become more apparent from the following detailed description of a preferred embodiment of the present invention when taken in conjunction with accompanying drawings.

DESCRIPTION OF THE PREFERRED EMBODIMENT

Figure 1:
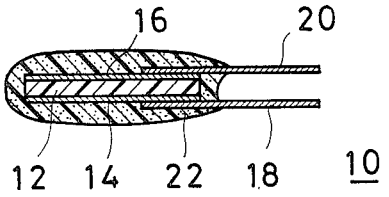
FIG. 1 is an illustrated sectional view showing one embodiment of the present invention.

FIG. 1 is an illustrated sectional view showing one embodiment of the present invention. An organic positive temperature coefficient thermistor 10 comprises, for example, a disc-shaped organic positive temperature coefficient thermistor element 12. The thermistor element 12, as already well-known, is composed of a high-molecular material, for example, such as polyethylene each being bridge together and mixed further with conductive particles, for example, such as carbon black. The resin such as the polyethylene expands as the temperature increases, and serves to increase the distance between the conductive particles. Thus the thermistor element 12 shows a positive temperature-resistance coefficient such as the increase in resistance value with the temperature rise.

On both main surfaces of the thermistor element 12, electrodes 14 and 16 are formed respectively. As the electrodes 14 and 16, a metal foil composed of, for example, copper or nickel is used, and lead wires 18 and 20 are respectively connected thereto.

Furthermore, an outer member 22 is formed to cover the thermistor element 12, the electrodes 14 and 16 and a portion of the lead wires 18 and 20. The outer member 22 is formed of a synthetic resin, for example, such as epoxy resin, containing an insulating filler therein. As the material of the filler, silica, alumina, aluminum hydroxide, talc, calcium carbonate and so on may be used. The content of filler in the resin is 60 wt%–80 wt%. Accordingly, since the amount of resin used can be reduced by including the filler in the outer member, the cost of the organic positive temperature coefficient thermistor may be reduced as a whole. In addition, by including the filler, in the outer member even when the difference of thermal expansion coefficient between the outer member and the thermistor element tends to increase, since the air existing on the surface of the filler mitigates the above described difference, a high heat-shock resistance will be anticipated.

EXPERIMENT I

In the experiment I, the outer member 22 (FIG. 1) was first formed under the conditions shown in the following table and five samples I, II, III, IV and V were obtained.

TABLE

| Sample Number | Main Ingredients (wt) Epoxy Resin | Filler $SiO_2$ | Filler $Al(OH)_3$ | Filler $C_aCO_3$ | Filler Contents of Outer Member (wt %) | Curing Conditions | Film Thickness (μm) |
|---|---|---|---|---|---|---|---|
| I | 100 | 200 | 200 | 167 | 85 | 80° C./1 Hr + 100° C./2 Hrs | 500 |
| II | 100 | 200 | 100 | 100 | 80 | " | " |
| III | 100 | 100 | 100 | 33 | 70 | " | " |
| IV | 100 | 100 | 25 | 25 | 60 | " | " |
| V | 100 | 50 | 50 | 22 | 55 | " | " |

In the preceding table, the curing conditions were adapted to cure the main ingredients by applying heat at 80° C. for one hour and further at 100° C. for two hours.

Figure 2:
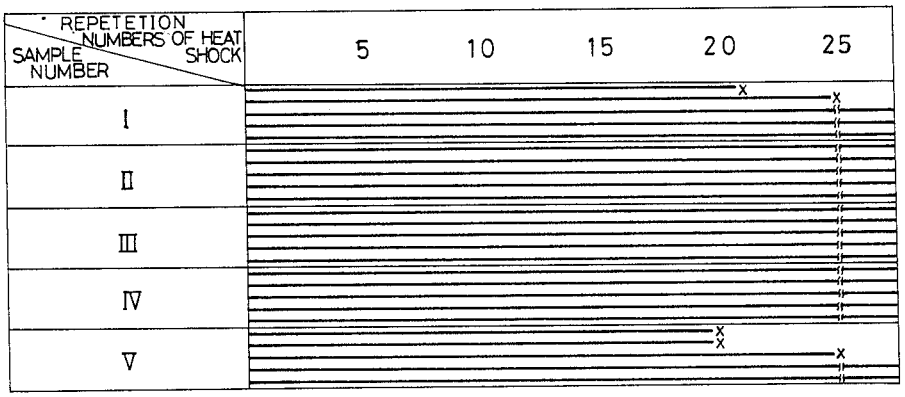
FIG. 2 is a graph showing the result of experiment example I.

Then a heat-shock test was performed on each of the five samples of I–V, whereby the number cycles endurable against the heat-shock was checked by counting the retention of each sample within a constant temperature bath at −50° C. for five minutes, and another five minutes at 120° C. immediately thereafter as one cycle, the results of which are shown in FIG. 2.

As it will be apparent from FIG. 2, with respect to the sample I, three out of five samples were endurable against the heat-shock for more than 25 cycles (cycles to be endured for the practical use), but one sample was damaged at the 25th cycle and the last was damaged at the 22nd cycle. As to the sample V, two out of five samples endured against the heat-shock for more than 25 cycles, but one was damaged at the 25th cycle and the other two were damaged at the 20th cycle. However, for the samples II–IV, all samples were endurable against the heat-shock for more than 25 cycles.

As such, in the sample I with the outer member 22 (FIG. 1) having the filler content of 85 wt%, the bridging density of the resin became non-uniform due to the excessive filler content, and the weak bonding forces between each filler or between the outer member and the thermistor element caused the deterioration of the heat-shock resistance, thus resulted in the damage of outer member. While, in the sample V with the outer member 22 having the filler content of 55 wt%, the bridging density of the resin became too high due to the insufficient filler content, a firm tertiary structure was formed, thus resulted in the damage of the thermistor element itself. However, the samples II–IV having the filler content of 60 wt%–80 wt% were endurable against the heat-shock for the practical use.

From the result of experiment I, it will be apparent that, if the resin containing the filler content of 60 wt%–80 wt% is used as the outer member, the heat-shock resistance thereof will be improved by the proper mixing balance between the resin and the filler, and the outer member which is sufficiently endurable for the practical use as the protector can be obtained.

Meanwhile, when the filler content is raised above 80 wt%, it becomes practically useless because of the deterioration of forming property as the outer member, so that in the present invention, the filler content above 80 wt% was excluded.

EXPERIMENT II

In the experiment II, first the samples I–V which are the same as the samples used in the experiment I were prepared.

Then, the lead wires of each sample were connected to a variable voltage AC power source to apply the voltage. In the test, the voltage of 30–45 V was applied during the first 30 seconds and then raised to 120 V during the following two minutes. Meanwhile, when applying the voltage of 120 V, the samples and the power source was disconnected at the fixed intervals. Then, after disconnecting the samples and the power source, the samples were retained at the room temperature (25° C.) for 30 minutes and the initial resistance values thereof were measured, the results of which are shown in FIG. 3.

Figure 3:
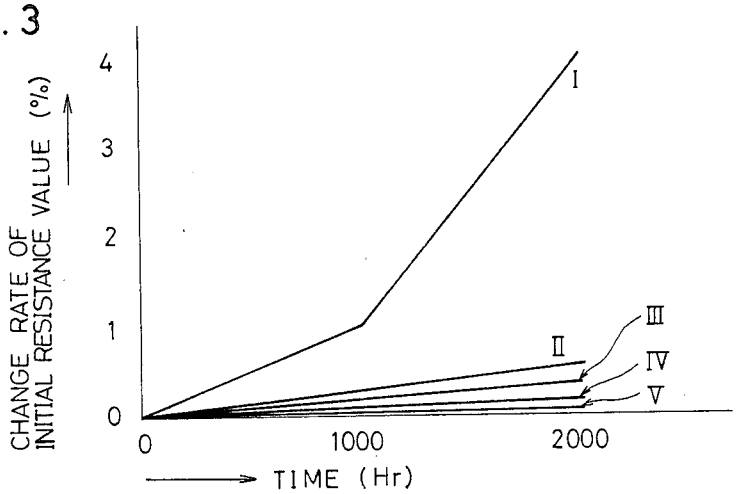
FIG. 3 is a graph showing the result of experiment example II, wherein the lapse of time and the changing rate of the initial resistance value are shown respectively on the abscissa and ordinate.

FIG. 3 is a graph showing the time on the abscissa, and the changing rate of the initial resistance value based upon the initial resistance value of each sample I–V before applying the voltage, on the ordinate.

As it will be apparent from FIG. 3, with respect to the sample I, because of the high filler content of the outer member, the oxygen transmittance thereof becomes excessively large and the changing rate of the initial resistance value increases as the time of applying the voltage elapses, and thus the device becomes practically useless. However, for the samples II–V, the oxygen transmittance of the outer member is moderately restricted and the changing rate of the initial resistance remains small even after 2000 hours, thus the thermistors which are sufficiently endurable for the practical use were obtained.

From the results of experiment II, it will be apparent that the less the filler content in the outer member, the better the electrical temperature coefficient of the organic positive temperature coefficient thermistor. In addition, when the outer member comprising the resin which contains less than 80 wt% of filler is used, from the results of samples II–V, it is confirmed that the electrical temperature coefficient of the organic positive temperature coefficient thermistor is practically negligible. However, even for the outer member containing the filler, if the filler content exceeds 80 wt%, from the result of sample I, it is apparent that the deterioration of initial resistance increases as the time elapses. Accordingly, it is desirable to keep the filler content below 80 wt%.

Meanwhile, if the filler content falls below 60 wt%, as it will be apparent from the experiment I, the thermal expansion coefficient of the outer member tends to increase, and therefore the outer member is not able to absorb and moderate the difference of thermal expansion with the thermistor element, and the heat-shock resistance is worsened excessively as in the prior art, so that in the present invention, for obtaining the organic positive temperature coefficient thermistor having a stable electrical temperature coefficient which satisfies the heat-shock resistance, the content of filler to be contained in the resin has been determined within the range of 60 wt%–80 wt%.

Meanwhile, although the oxygen transmittance of the outer member 22 varies by changing, for example, the mixing ratio of the resin, filler and binder which are to be used as the material thereof, the baking temperature for baking and the film thickness thereof, the outer member 22 containing the filler within the range of content described above, shields the oxygen to the extent available for the practical use. The oxygen transmittance of the outer member of samples II–IV within the range of above described filler content were respectively $6\times10^{-7}$, $3\times10^{-7}$, $7\times10^{-9}$, $7\times10^{-9}$ cc/cm$^2$/mm/sec./cmHg. This shows that, although it is disclosed in U.S. Pat. No. 4,315,237 to keep the oxygen transmittance of the outer member preferably below $5\times10^{-9}$ cc/cm$^2$/mm/sec./cmHG, it is practically negligible to bring the oxygen transmittance of the outer member above $5\times10^{-9}$ cc/cm$^2$/mm/sec./cmHg, for example, to $6\times10^{-7}$/cm$^2$/mm/sec./cm Hg as the sample II, by including the filler therein. For reference, the oxygen transmittance of sample I and V were respectively $7\times10^{-6}$ and $3\times10^{-9}$ cc/cm$^2$/mm/sec./cmHg.

Although an embodiment of the present invention has been described and illustrated in detail, it is clearly understood that the same is by way of illustration and example only and is not to be taken by way of limitation, the spirit and scope of the present invention being limited only by the terms of the appended claims.

What is claimed is:

1. An organic positive temperature coefficient thermistor, comprising:

an organic positive temperature coefficient thermistor element, an electrode connected to said organic positive temperature coefficient thermistor element, and an outer member formed around said organic positive temperature coefficient thermistor element composed of resin containing 60 wt%–80 wt% of an insulating filler.

2. An organic positive temperature coefficient thermistor in accordance with claim 1, wherein said insulating filler is selected from a group including silica, alumina, aluminum hydroxide, talc and calcium carbonate.

3. An organic positive temperature coefficient thermistor in accordance with claim 1, wherein said insulating filler is composed of an inorganic material.

4. An organic positive temperature coefficient thermistor in accordance with claim 1, wherein said resin is an expoxy resin.

* * * * *